US012121091B2

(12) United States Patent
Hourani

(10) Patent No.: US 12,121,091 B2
(45) **Date of Patent: *Oct. 22, 2024**

(54) GARMENT WITH INSULATED CONTAINER

(71) Applicant: Michael Hourani, Medford, NJ (US)

(72) Inventor: Michael Hourani, Medford, NJ (US)

( * ) Notice: Subject to any disclaimer, the term of this patent is extended or adjusted under 35 U.S.C. 154(b) by 235 days.

This patent is subject to a terminal disclaimer.

(21) Appl. No.: 17/893,630

(22) Filed: Aug. 23, 2022

(65) Prior Publication Data

US 2022/0400796 A1 Dec. 22, 2022

Related U.S. Application Data

(63) Continuation-in-part of application No. 15/925,810, filed on Mar. 20, 2018, now Pat. No. 11,452,323.

(51) Int. Cl.
*A41D 27/00* (2006.01)
*A41D 27/20* (2006.01)

(52) U.S. Cl.
CPC ..... *A41D 27/208* (2013.01); *A41D 2200/20* (2013.01)

(58) Field of Classification Search
CPC ... A41D 27/207; B65D 81/3897; B65D 85/36
See application file for complete search history.

(56) References Cited

U.S. PATENT DOCUMENTS 1,883,461 A * 10/1932 Baccaro ..... A41D 27/20 2/247
2,436,879 A * 3/1948 Buck ..... A41D 27/20 2/248
2,609,855 A * 9/1952 Rothschild ..... A45C 13/185 150/134
2,908,306 A * 10/1959 Chorost ..... A45C 13/185 150/134
4,145,762 A * 3/1979 Wallach ..... A41D 7/005 2/238
4,940,173 A * 7/1990 Jacober ..... A45C 11/20 224/583
5,013,271 A * 5/1991 Bartlett ..... A41D 13/012 441/106
5,030,013 A * 7/1991 Kramer ..... A45C 13/10 383/90
5,244,136 A * 9/1993 Collaso ..... A45F 5/021 383/89
5,255,392 A * 10/1993 Stanislaw ..... A41D 27/208 2/403
5,421,032 A * 6/1995 Murphy ..... A41D 27/208 2/247
5,524,802 A * 6/1996 Benson ..... A45C 1/04 224/660
5,639,523 A * 6/1997 Ellis ..... B65D 5/425 229/175

(Continued)

*Primary Examiner* — Richale L Quinn

(74) *Attorney, Agent, or Firm* — Andrew Morabito

(57) ABSTRACT

A garment, comprising: a torso portion adapted to extend around at least a portion of a wearer's torso and having a hood, two sleeve portions and having a concealed pocket, wherein the torso portion having a first opening providing access to the pocket, and wherein the first opening has a reusable closing mechanism; and an insulated deformable container, wherein the insulated deformable container fits within the concealed pocket.

10 Claims, 6 Drawing Sheets

(56) References Cited

U.S. PATENT DOCUMENTS 5,771,496 A * 6/1998 Wood ..... A41D 27/20 2/243.1
5,787,505 A * 8/1998 Piwko ..... A41D 13/0058 2/247
5,815,845 A * 10/1998 Ault ..... A45C 1/06 2/249
5,878,441 A * 3/1999 Busker ..... A41D 27/208 2/250
6,260,199 B1 * 7/2001 Grunstein ..... B63C 9/093 441/115
6,405,376 B1 * 6/2002 Falk ..... A41D 31/102 2/102
6,760,922 B1 * 7/2004 Morales ..... A41D 13/0012 2/102
6,769,139 B1 * 8/2004 Goldkind ..... A41D 27/20 2/247
6,820,281 B2 * 11/2004 Mariland ..... A41D 13/0015 2/69
8,402,562 B1 * 3/2013 Seddiki ..... A41D 27/205 2/247
8,484,765 B2 * 7/2013 French ..... F41C 33/0209 2/250
8,756,717 B2 * 6/2014 Claeys ..... A41D 27/20 2/250
9,295,293 B2 * 3/2016 Rosenhaus ..... A41D 1/14
9,445,637 B2 * 9/2016 Buczkowski ..... A41D 27/205
9,557,139 B1 * 1/2017 Miner ..... A44B 18/0073
D835,385 S * 12/2018 Noll ..... D2/828
11,026,457 B1 * 6/2021 Mayer ..... A41D 27/201
11,330,854 B2 * 5/2022 Abukashef ..... A41D 1/04
11,896,069 B1 * 2/2024 Boord ..... A41D 27/20
2015/0359280 A1 * 12/2015 Chang ..... A41D 13/0012 2/249
2017/0079350 A1 * 3/2017 Hourani ..... A41D 27/201
2019/0000157 A1 * 1/2019 Bhaskaran ..... A41D 27/20
2019/0075917 A1 * 3/2019 Preston ..... A41D 27/20
2020/0337398 A1 * 10/2020 Coutelin ..... A41D 27/201
2021/0267291 A1 * 9/2021 Mayer ..... A41D 27/201

* cited by examiner

GARMENT WITH INSULATED CONTAINER

CROSS-REFERENCE TO RELATED APPLICATIONS

This application is a continuation-in-part (and claims the benefit of priority under 35 USC 120) of U.S. application Ser. No. 15/925,810 filed Mar. 20, 2018. The disclosure of the prior applications is considered part of (and is incorporated by reference in) the disclosure of this application.

BACKGROUND OF THE INVENTION

The present invention relates to garment, and more particularly to a garment with an insulated container to store hot or cold items.

It is often desirable to prepare a lunch or other meal for consumption at a remote location and at a later time. The food is generally prepared and placed within a reusable carrying container and then transported and stored within the reusable container until it is time to consume the food. These reusable containers, especially the interior surface, may become dirty through use and contact with food items. The containers are also burdensome to carry and difficult to take with oneself to various locations. It is also desirable to maintain the food items in a cold or hot condition for a period of time, it would also be desirable if the reusable food transportation and storage container having a launderable or easily cleaned surface also included an insulated food storage chamber.

It is desired to have an article of clothing with an insulated container that may store and maintain the temperature of hot or cold food or items and remove the necessity to carry around a cooler or insulated container.

SUMMARY

Accordingly, it is an objective of the present invention to describe a hooded garment with a pocket and container, comprising: a torso portion adapted to extend around at least a portion of a wearer's torso and having a hood, two sleeve portions, a pouch distal to a lower opening, the torso portion having a front and a back, and having a concealed pocket integrated into the front of the torso portion- and positioned above the pouch, wherein the torso portion having a first opening providing access to the pocket, and wherein the first opening has a reusable closing mechanism; and an insulated container comprising; at least one interior layer comprised of a food safe and waterproof material, at least one middle layers, wherein the at least one middle layers are thermally insulated, an exterior water-resistant layer, wherein the insulated container has a first end, a second end, and a second opening disposed at the first end providing access to an interior space, and wherein a flap extending from the first end a first portion of a water permeable securing means is attached to the flap and a second portion of the water permeable securing means is attached distal to the first end, wherein a first portion of the securing means is embedded within the flap and a second portion of the securing means is embedded within the container in proximity to the second opening, wherein when the flap is folded over the second opening the first portion and the second portion of the securing means substantially aligns and secure, wherein the insulated container is sized and configured to engage and nest within the pocket, and the pocket which is sized and configured to receive the insulated container and secure the insulated container in a predetermined orientation and a third securing means integrated into the interior of the pocket and a fourth securing means integrated into the exterior water resistant layer of the insulated container, and wherein the third and fourth securing means are positioned so when the insulated container is positioned within the pocket, the third securing means engages with the fourth securing means; wherein a first portion of the securing means is disposed on an interior surface of the flap and a second portion of the securing means is disposed on an exterior surface of the insulated container, wherein when the flap is folded over the second opening the first portion and the second portion of the securing means substantially aligns and secure; and the first opening and the second opening substantially align, wherein the insulated container can be accessed without physically removing the insulated container from the pocket.

In another embodiment, the present invention is a garment with a pocket and thermally insulated and deformable container, comprising, a garment with at least one pocket, wherein the garment has a first opening providing access to the at least one pocket, an container having an internal compartment comprising, an interior layer made of food safe material having an interior surface and an external surface, at least one middle layers of thermally insulating material joined to the exterior surface of the interior layer, and an exterior layer of a metallized material joined to an outermost layer of the at least one middle layers, wherein, the container is sized to securely fit within one of the at least one pocket.

In yet another embodiment, the present invention is a garment with a pocket and thermally insulated and deformable container, comprising, a garment with at least one pocket, wherein the garment has a first opening providing access to the at least one pocket, an container comprised of an interior layer made of food safe material having an interior surface and an external surface, at least one middle layers of thermally insulating material joined to the exterior surface of the interior layer, and an exterior layer of a metallized material joined to an outermost layer of the at least one middle layers, wherein the interior layer, the at least one middle layers, and the exterior layer form a single sheet, which is folded and sealed along the edge to create a substantially air tight internal compartment, and the container is sized to securely fit within one of the at least one pocket.

DETAILED DESCRIPTION OF THE INVENTION

The present invention provides a garment that has a closeable pocket with an insulated container secured inside. The insulated container allows the wearer to keep the contents at a consistent temperature without the need to carry around additional containers or items.

As will be apparent to those of skill in the art upon reading this disclosure, each of the individual embodiments described and illustrated herein have discrete components and features which may be readily separated from or combined with the features of any of the other several embodiments without departing from the scope or spirit of the present invention. It is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Unless defined otherwise, all technical and scientific terms used herein have the same meaning as commonly understood by one of ordinary skill in the art to which this invention belongs. Although any methods and materials similar or equivalent to those described herein may also be used in the practice or testing of the present invention, the preferred methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present invention is not entitled to antedate such publication by virtue of prior invention. Further, the dates of publication provided may be different from the actual publication dates which may need to be independently confirmed.

It must be noted that as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements or use of a "negative" limitation.

Figure 1:
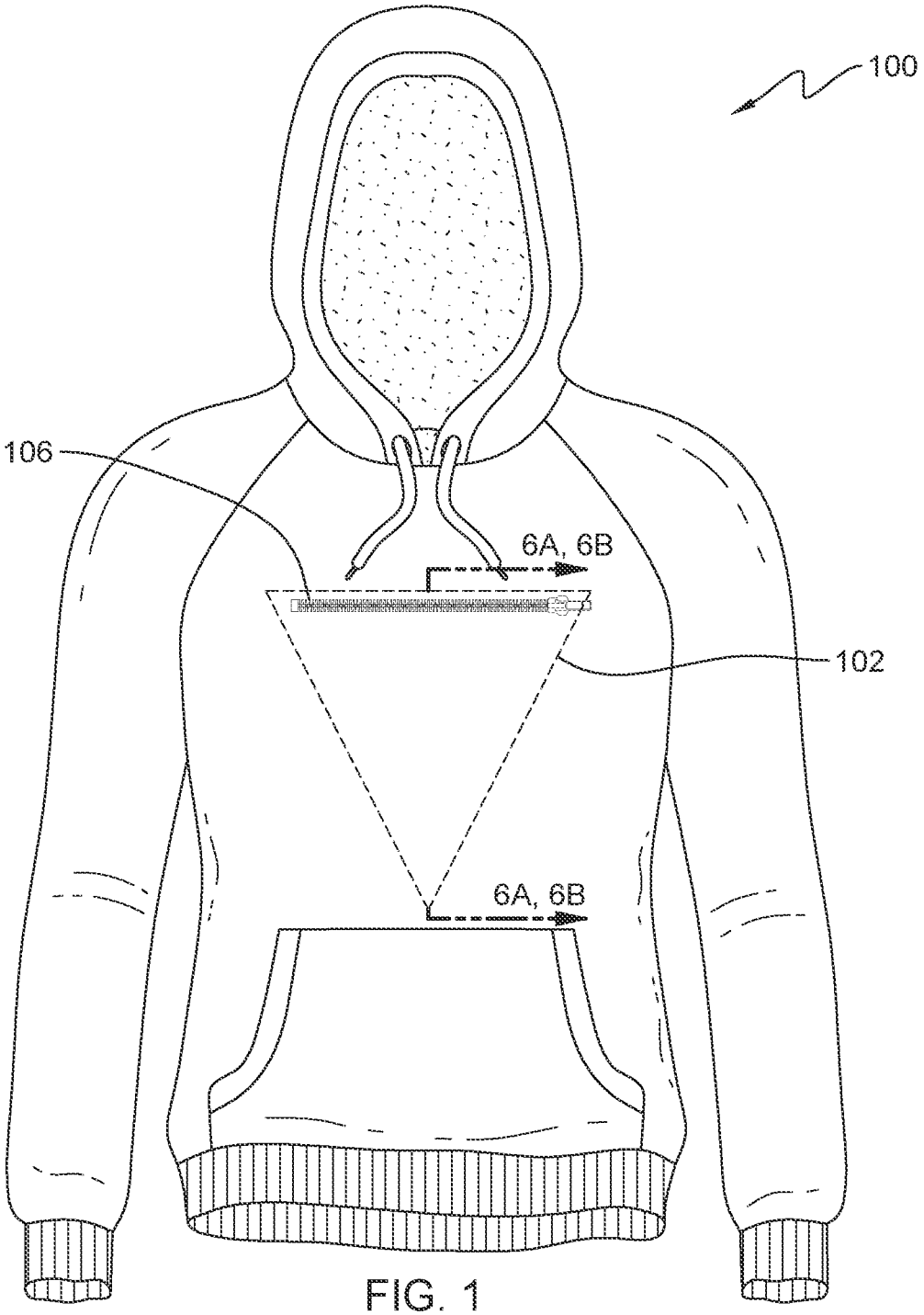
FIG. 1 depicts a front view of a garment, in accordance with one embodiment of the present invention.

FIG. 1 depicts a front view of a garment 100 with a pocket 102 adapted to receive an insulated container 200 (not shown), in accordance with one embodiment of the present invention. The garment 100 may be, but not limited to various jackets, hooded sweatshirts, sweaters, shirts, under garments, outer-wear or other apparel which the pocket 102 may be disposed on or in the garment. In some embodiments, the garment 100 is a pair of pants or garment which is typically worn over the persons legs. In the depicted embodiment, a hooded sweatshirt is shown. The garment 100 may be made from various fabrics and materials. In the depicted embodiment, the garment 100 appears to be a conventional garment with the insulated container 200 placed within the pocket 102 and hidden from view. Additionally, in the depicted embodiment, the pocket 102 is concealed or hidden from view and is attached or stitched into the garment 100 internally to minimize visibility of the pocket 102. In the depicted embodiment, the pocket 102 is located on the chest of the wearer. In additional embodiments, the pocket 102 may be located on the arms, back, sides, or other areas of the garment. The fastener 106 is the only visible portion of the pocket 102. In additional embodiments, the pocket 102 is attached or secured to the garment 100 on the exterior surface and is visible. The insulated container (not shown) is designed to securely nest or fit comfortably within the pocket 102. The insulated container 200 is easily removed from the pocket 102. In the depicted embodiment, the pocket 102 is triangular in shape, and with the insulated container 200 being sized and shaped to fit within the pocket, the insulated container 200 is less likely to be jostled or move around within the pocket 102. In additional embodiments the pocket 102 may be a variety of shapes such as, but not limited to, a circle, square, rectangle, and the like; provided the opening to the pocket 104 is able to receive the pocket 102.

The pocket 102 is designed to securely fit a container 200 (not shown) within the pocket 102. In the depicted embodiment, the pocket 102 has a triangular shape and is shown with the hidden line. In some embodiments, the pocket 102 is stitched into the garment 100 to be hidden. In other embodiments, the stitching of the pocket 102 may be visible from the exterior of the garment 100. In additional embodiments, the pocket 102 may have various shapes, e.g. rectangular, circular, square, and the like. In some embodiments, the pocket 102 may have more than one section within the pocket 102, such that a divider is used to separate the pocket 102 into more than one section. The pocket 102 has an opening 104 to allow access to the pocket 102. In the depicted embodiment, the opening 104 has a zip style fastener 106 to close the pocket 102. In additional embodiments, various types of fasteners 106 may be used to secure the pocket 102. The fastener 106 may be, but not limited to, zippers, hook and loop fasteners, or other recloseable fasteners. In some embodiments, the fastener 106 spans the entire length of the opening 104. In some embodiments, the fastener 106 spans a predetermined distance of the opening 104. In some embodiments, the pocket 102 is sized to fit two or more insulated containers 200. This may be side by side or in rows based on the size and the shape of the insulated containers 200. In some embodiments, the insulated container 200 has a securing means on an exterior surface and the pocket has a mating securing means, where the insulated container 200 can be secured within the pocket 102 via the securing means, so the insulated container 200 does not move or shift within the pocket 102.

Figure 2:
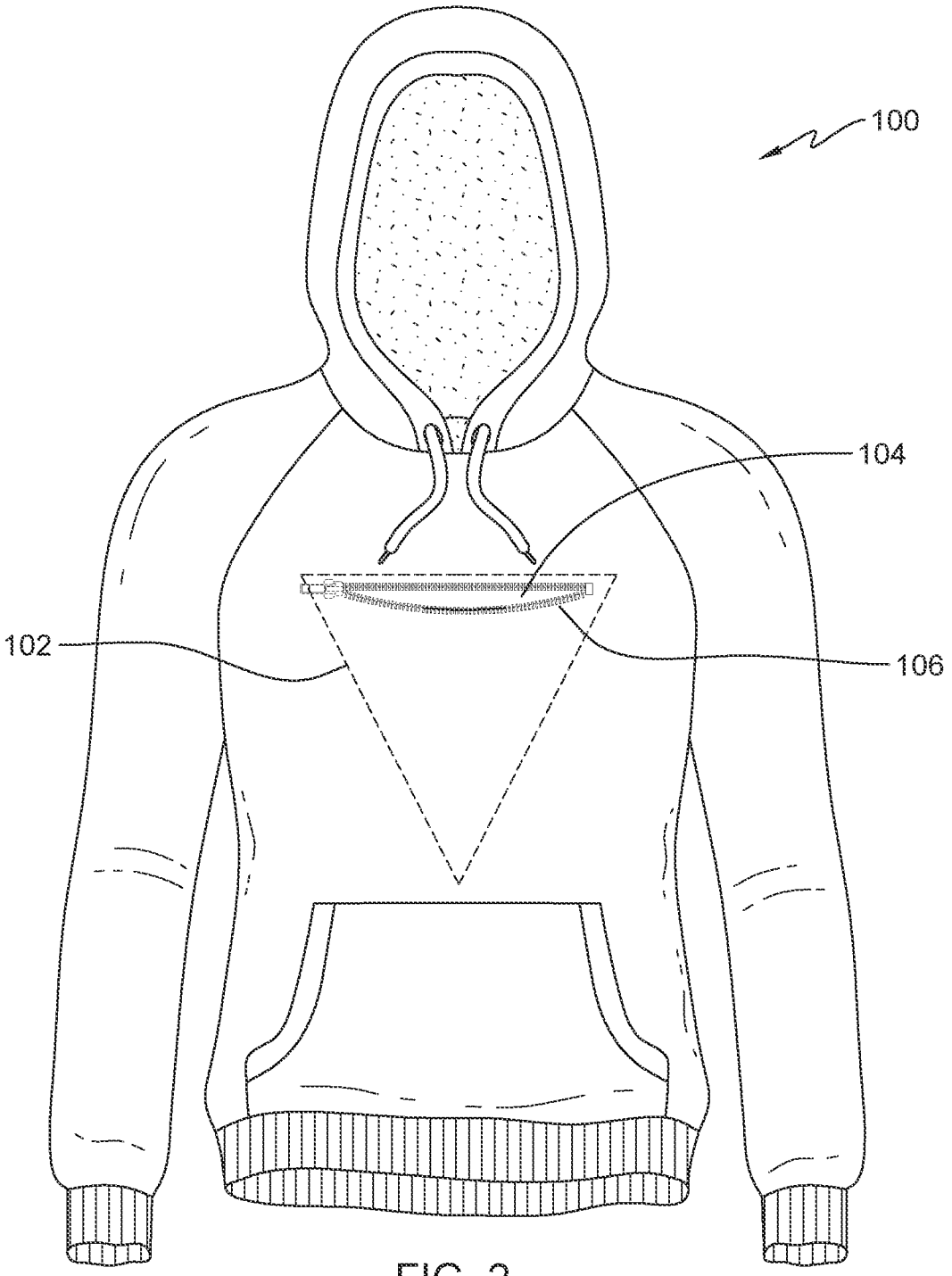
FIG. 2 depicts another front view of the garment, in accordance with one embodiment of the present invention.

FIG. 2 depicts the fastener 106 in the open position allowing access to the pocket 102. In some embodiments, the garment 100 may have multiple pockets 102 with multiple openings 104.

In some embodiments, there is a securing means which is used to secure the container 200 within the pocket 102. This is accomplished by a first portion of the securing means being secured to the inside of the pocket 102 in a predetermined location and second portion of the securing means being secured to the exterior surface of the container 200, and when the container 200 is placed within the pocket 102 the two portions align and secure the container 200 in place. This securing means may be, but not limited to, a hook and loop fastener, or mating adhesive or magnetic pads.

Figure 3:
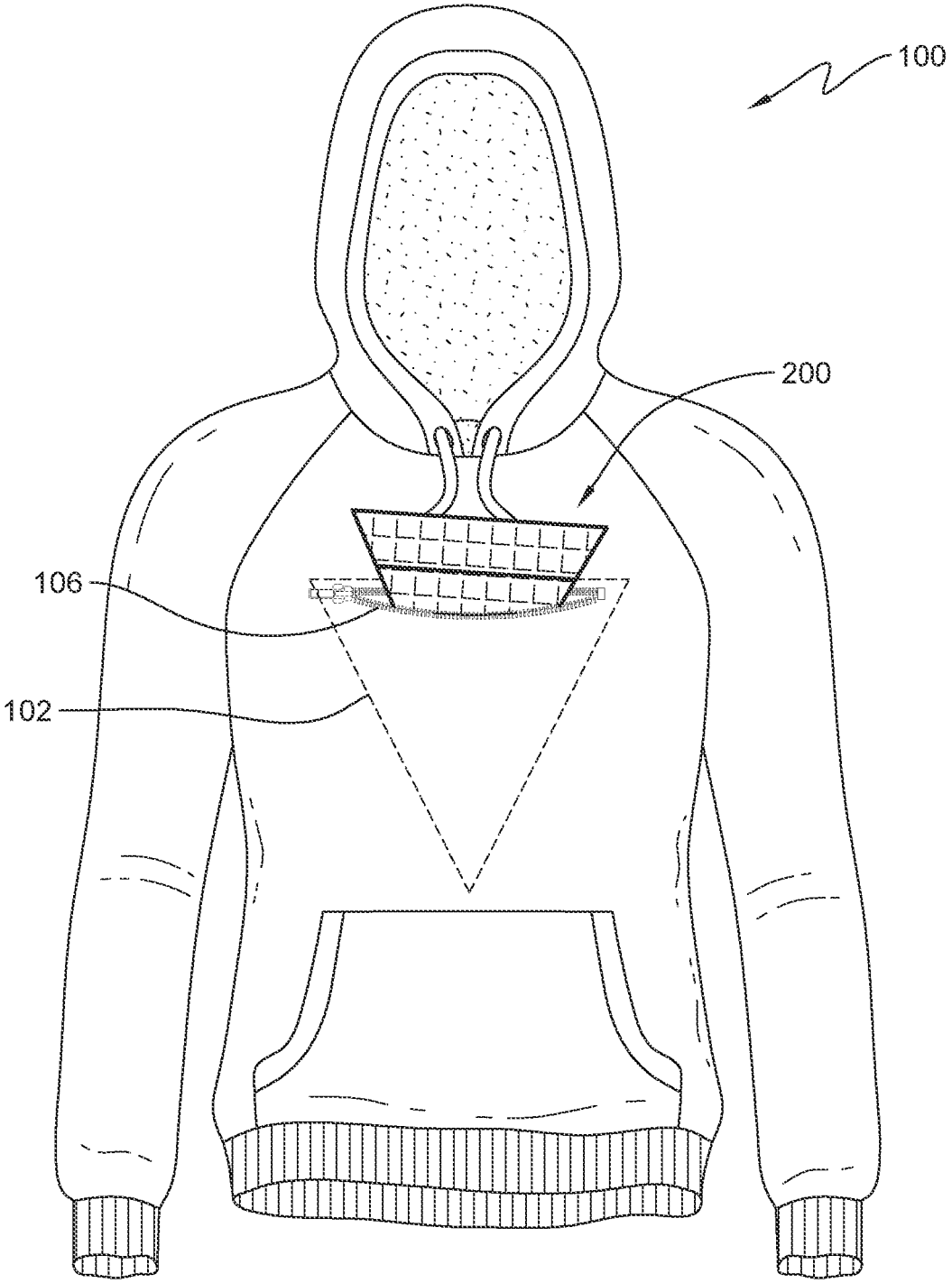
FIG. 3 depicts a front view of the garment with an insulated container partially removed, in accordance with one embodiment of the present invention.

FIG. 3 depicts a front view of the garment 100 with an insulated container 200 partially removed, in accordance with one embodiment of the present invention. In the depicted embodiments, the fastener 106 is opened, and the insulated container 200 is partially removed from the pocket 102 through the opening 104. The insulated container 200 maybe any shape or size that is able to also fit within the pocket 102. The opening 104 is sized to easily fit the insulated container 200 within the pocket 102, and the fastener 106 spans a predetermined distance of the opening 104 to allow for an unobstructed inserting or removal of the insulated container 200 from the pocket 102 through the opening 104. In some embodiments, the insulated container 200 has a fastening means (not shown) to secure the insulated container 200 within the pocket 102 so that the insulated container 200 does not shift or adjust position once inside the pocket 102. This may be done through various hook and loop style fasteners stitched into the pocket 102 with the reciprocal portion of the fastener secured to the insulated container 200, so that when the insulated container 200 is inserted into the pocket 102 the fastening means substantially aligns and secures.

Figure 4:
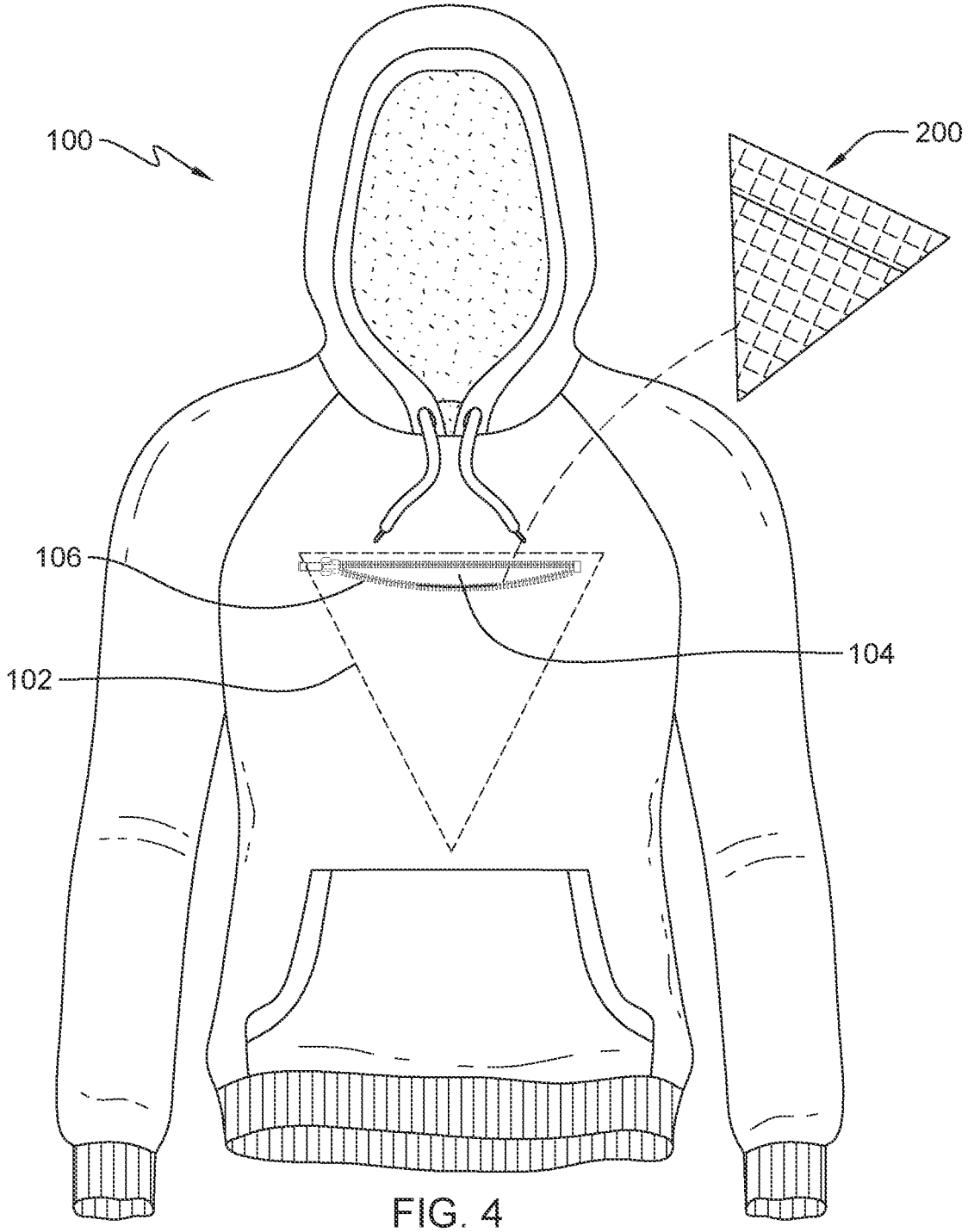
FIG. 4 depicts a front view of the garment with the insulated container removed, in accordance with one embodiment of the present invention.

FIG. 4 depicts a front view of a garment 100 with the insulated container 200 removed, in accordance with one embodiment of the present invention. In the depicted embodiment, the insulated container 200 is a triangular shape and the pocket 102 has a substantially similar shape. This assists in securing the insulated container 200 in a predetermined position and further keeps the insulated container 200 in a set position, thereby protecting the contents of the insulated container 200 from tipping or moving around.

Figure 5:
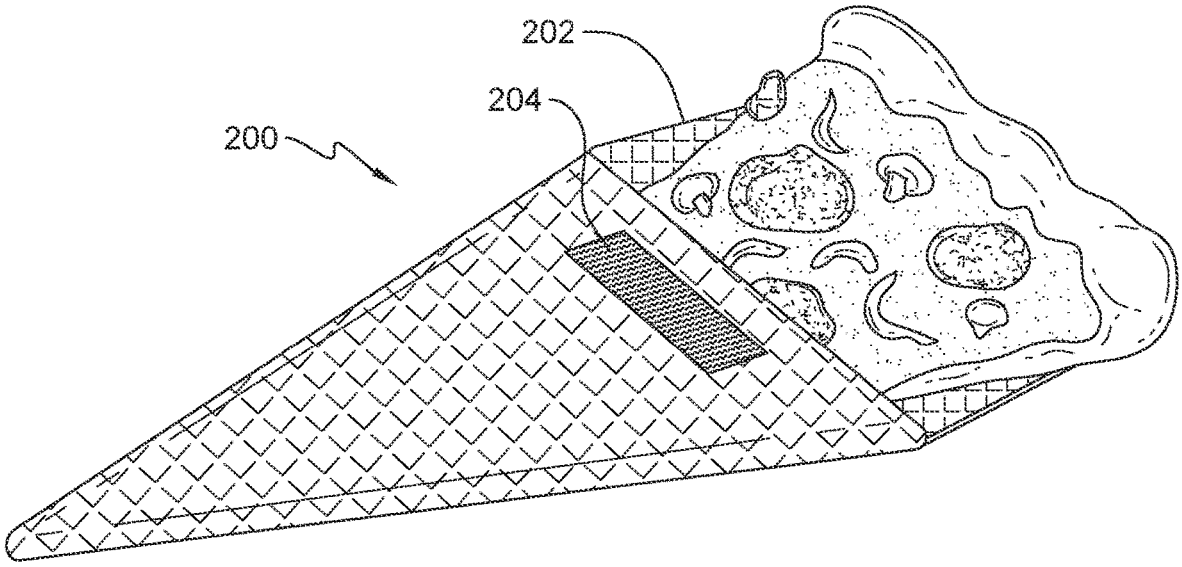
FIG. 5 depicts the insulated container in an open position, in accordance with one embodiment of the present invention.

FIG. 5 depicts the insulated container 200 in an open position, in accordance with one embodiment of the present invention. The insulated container 200 is designed to reduce the transfer of heat from the food or contents for an extended period of time. In the depicted embodiment, the insulated container 200 has an enveloping design. The insulated container 200 may be made of single sheet and bonded along one edge to create a substantially airtight and water tight design, except for the opening which allows access to the internal compartment. The insulated container 200 may be may from more than one layer of material to provide a food safe layer to come in contact with the food, and an insulation layer to assist with keeping the item within the pocket warm or cold (based on the item). In some embodiments, a single layer of material is able to provide these features.

In one embodiment, the insulated container 200 has an interior layer or skin which comes in contact with the contents of the insulated container 200 is a Food and Drug Administration (FDA) approved material to come in contact with food, such as, paraffin, or paraffin combined with different percentages of other materials, such as stearic acid, carnauba wax, or sodium chloride to obtain higher fusion temperatures. This interior layer may also provide insulation for the insulated container 200. In some embodiments, a middle layer of insulating material bonded to the interior layer, wherein the middle layer may be made from foam (e.g. polyurethane, polyethylene, and the like), bubble wrap, polyurethane, wool, polystyrene, or the like. The middle layer may be comprised of multiple layers of insulating material. The middle layer may be made of a relatively wear resistant material. In some embodiments, the interior layer and the middle layer(s) are a unitary design. An exterior layer of metallized film is bonded to an exterior of the insulated container 200. The metallized film is designed to provide additional insulation, strength, and reduces the permeability of the insulated container 200 to light, water, and oxygen. The various layers of the insulated container 200 may be secured together through various bonding, welding, and joining processes known to those skilled in the art.

In one embodiment, the insulated container 200 has a temperature range of −60 to 180 degrees Fahrenheit, to protect the wearer's skin. This allows the wearer to have a relatively hot or cold item within the insulated container 200 and will not experience any discomfort while wearing the garment. In one embodiment, the thickness of the insulated container 200 ranges from 0.156 to 0.250 inches from the front exterior surface to the rear exterior surface. This provides a thickness that once an item is placed within the insulated container 200 will not be noticeable or uncomfortable for the wearer.

In some embodiments, the insulated container 200 may be constructed to have the exterior layer of metallized film, and a layer of insulating bubbles which resists heat, and an interior layer of polyethylene (or another food safe material). In some embodiments, the insulated container 200 is an interior layer and an exterior layer only. In additional embodiments, additional layers, placed between the interior and exterior layers may be used to further enhance the retaining quality of the insulated container 200. In some embodiments, the insulated container 200 is substantially waterproof.

In the depicted embodiment, the insulated container 200 has a cover or flap 202, which extends beyond the opening to the internal compartment, that is used to secure over the opening and secure the contents within the compartment. The cover 202 is folded over the opening and a securing mechanism (not shown) substantially aligns with the securing means 204 exposed on the exterior surface. The securing means 204, in the depicted embodiment, is a hook and loop fastener with one portion placed on the cover 202 and the other portion positioned on the exterior surface of the insulated container 200. Various fastening means may be employed to replace the hook and loop style fastener known to those skilled in the art. In some embodiments, the cover 202 is removed, and a zip-locking closure mechanism is placed near the interior edge of the opening to provide a substantially air and water tight seal. In some embodiments, both the securing mechanism 204 and a zip-locking mechanism are incorporated into the insulated container 200.

The interior compartment is sized to fit various items including food, medicine, and other objects where the wearer would desire that the item be insulated. The insulated container 200 is designed wherein the volume of the internal compartment may comfortably fit the item which is desired to fit within. In the depicted embodiment, the insulated container 200 is designed to fit a single slice of pizza without the slice of pizza being compressed or flattened when the insulated container 200 is closed.

Figure 6A:
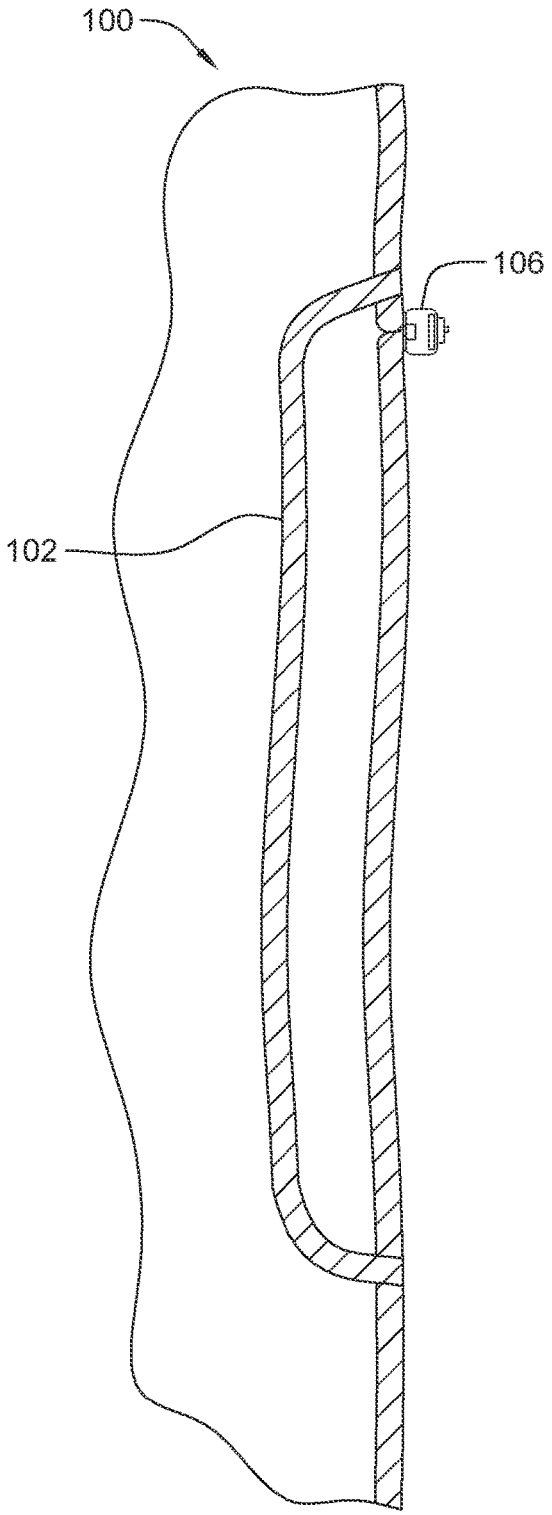
FIG. 6A depicts a section view of the garment without the insulated container, in accordance with one embodiment of the present invention.
Figure 6B:
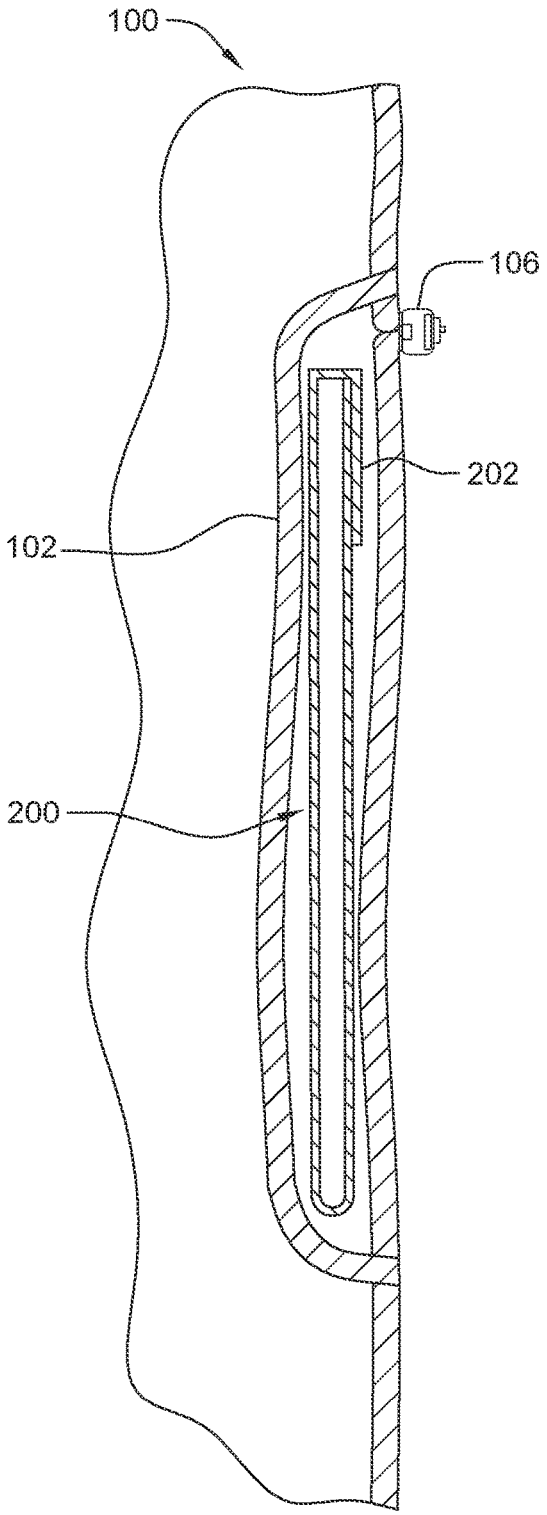
FIG. 6B depicts a section view of the garment with the insulated container, in accordance with one embodiment of the present invention.

FIGS. 6A and B depict a cross section view of the garment 100 with the insulated container 200. This shows how the insulated container 200 is hidden from the exterior surface of the garment 100 while minimally increasing the thickness of the garment 100. The pocket 102 is designed to provide adequate thickness to fit the insulated container 200. In some embodiments, the insulated container 200 is permanently affixed within the pocket 102 and the cover 202 is removed from the insulated container 200 (not shown). The opening 104 would lead directly into the internal compartment of the insulated container 200. In these embodiments, the insulated container 200 may still have the securing means 204 in conjunction with the fastener 106. In FIG. 6B it shown that there is minimal excess space in the pocket 102 when the insulated container 200 is placed within the pocket 102

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

What is claimed is:

1. A hooded garment with a pocket and container, comprising:

a torso portion adapted to extend around at least a portion of a wearer's torso and having a hood, two sleeve portions, a pouch distal to a lower opening, the torso portion having a front and a back, and having a concealed pocket integrated into the front of the torso portion-and positioned above the pouch, wherein the torso portion having a first opening providing access to the pocket, and wherein the first opening has a reusable closing mechanism; and an insulated container comprising;

at least one interior layer comprised of a food safe and waterproof material, at least one middle layers, wherein the at least one middle layers are thermally insulated, an exterior water-resistant layer, wherein the insulated container has a first end, a second end, and a second opening disposed at the first end providing access to an interior space, and wherein a flap extending from the first end a first portion of a water permeable securing means is attached to the flap and a second portion of the water permeable securing means is attached distal to the first end, wherein a first portion of the securing means is embedded within the flap and a second portion of the securing means is embedded within the insulated container in proximity to the second opening, wherein when the flap is folded over the second opening the first portion and the second portion of the securing means substantially aligns and secure, wherein the insulated container is sized and configured to engage and nest within the pocket, and the pocket which is sized and configured to receive the insulated container and secure the insulated container in a predetermined orientation and a third securing means integrated into the interior of the pocket and a fourth securing means integrated into the exterior water resistant layer of the insulated container, and wherein the third and fourth securing means are positioned so when the insulated container is positioned within the pocket, the third securing means engages with the fourth securing means;

wherein a first portion of the securing means is disposed on an interior surface of the flap and a second portion of the securing means is disposed on an exterior surface of the insulated container, wherein when the flap is folded over the second opening the first portion and the second portion of the securing means substantially aligns and secure; and the first opening and the second opening substantially align, wherein the insulated container can be accessed without physically removing the insulated container from the pocket.

2. A garment, comprising:

a torso portion adapted to extend around at least a portion of a wearer's torso and having a hood, two sleeve portions and having a concealed pocket, wherein the torso portion having a first opening providing access to the pocket, and wherein the first opening has a reusable closing mechanism; and an insulated deformable container, wherein the insulated deformable container is comprised of more than one layer and one of the layers is thermally insulated and one of the layers is metallized wherein the insulated container fits within the concealed pocket and wherein the insulated container further comprising, a flap extending from an opening of the insulated deformable container, wherein a first portion of a securing means is disposed on an interior surface of the flap and a second portion of the securing means is disposed on an exterior surface of the insulated deformable container.

3. The garment with an insulated container of claim 2, wherein the pocket is accessible from an interior surface of the garment.

4. The garment of claim 2, wherein the pocket is accessible from an exterior surface of the garment.

5. The garment of claim 2, wherein the layers has a food safe interior surface.

6. The garment of claim 2, wherein the pocket is triangular in shape.

7. The garment of claim 2, wherein more than one insulated deformable container fit within the pocket.

8. The garment of claim 2, wherein the opening of the insulated deformable container when placed within the pocket the opening of the insulated deformable container and the opening of the pocket align, wherein the insulated deformable container can be accessed without physically removing the insulated deformable container from the pocket is accessible through the opening of the pocket.

9. The garment of claim 2, wherein the pocket is concealed within the garment.

10. The garment of claim 2, wherein the pocket has a resealable closing mechanism secured to the opening.

* * * * *